US005831605A

United States Patent [19]

Yasui et al.

[11] Patent Number: 5,831,605

[45] Date of Patent: Nov. 3, 1998

[54] LIQUID CRYSTAL DISPLAY DEVICE WITH STABILIZED COMMON POTENTIAL

[75] Inventors: Masaru Yasui; Kenji Hanzawa; Yuko Hori, all of Kobe, Japan

[73] Assignee: Hosiden Corporation, Osaka, Japan

[21] Appl. No.: 794,515

[22] Filed: Feb. 3, 1997

[30] Foreign Application Priority Data

Feb. 9, 1996 [JP] Japan ..... 8-024389

[51] Int. Cl.[6] ..... G09G 5/00

[52] U.S. Cl. ..... 345/211; 345/204

[58] Field of Search ..... 345/94, 98, 150, 345/204, 211, 212

[56] References Cited

U.S. PATENT DOCUMENTS 5,537,129 7/1996 Okada et al. ..... 345/94
5,583,528 12/1996 Ebihara ..... 345/94

*Primary Examiner*—Matthew Luu
*Attorney, Agent, or Firm*—Pollock, Vande Sande & Priddy

[57] ABSTRACT

In a common potential stabilizing active matrix liquid crystal display device, the common potential is detected via a common potential detecting terminal provided at the perimeter of the common electrode, the detected potential is compared with a reference potential and the difference is amplified by an amplifier and is negatively fed back to a common potential supply terminal provided at the perimeter of the common electrode.

7 Claims, 6 Drawing Sheets

LIQUID CRYSTAL DISPLAY DEVICE WITH STABILIZED COMMON POTENTIAL

BACKGROUND OF THE INVENTION

The present invention relates to an active matrix liquid crystal display device, using thin film transistors, which is employed as a display for aircraft, computers, information terminal equipment and so forth and, more particularly, to an active matrix liquid crystal display device with a stabilized common electrode potential.

In FIG. 1 there is schematically shown the configuration of a prior art active matrix liquid crystal display (hereinafter referred to as an LCD) using thin film transistors (hereinafter referred to as TFTS) as switching elements. Reference numerals 11 and 12 denote transparent substrates opposing each other to form a liquid crystal panel 10. The substrate 11 is called an array substrate and the substrate 12 is a common substrate. As is well-known in the art, the array substrate 11 has gate lines $Y_1, Y_2, \ldots Y_m$ and source lines $X_1, X_2, \ldots X_n$ formed thereon in rows and columns and at least one TFT 3 as a switching element and a transparent pixel electrode 4 formed in each of the areas (pixel areas) defined by the gate and source lines $Y_1, Y_2, \ldots Y_m$ and $X_1, X_2, \ldots X_n$. The common substrate 12 has a common electrode 5 coated almost all over its inner surface. The substrates 11 and 12 are separated by liquid crystal sealed therebetween to form an active matrix LCD panel 10.

In the example of FIG. 1 each pixel area has one TFT 3, which has its source and gate connected to source and gate lines $X_i$ and $Y_j$ corresponding thereto and its drain connected to the pixel electrode 4. The source lines $X_1$ to $X_n$ are connected to a source driver 22 and the gate lines $Y_1$ to $Y_m$ are connected to a gate driver 23; the scanning by the source and gate drivers 22 and 23 is placed under the control of a control circuit 24. A graphic controller 21 provides an image data signal $D_S$ to the source driver 22 and a synchronizing signal SYN containing horizontal and vertical synchronizing signals Esyn and Vsyn to the control circuit 24. Based on the synchronizing signal SYN fed thereto from the graphic controller 21, the control circuit 24 generates a plurality of control signals Ssyn for the source driver 22 and a plurality of control signals Gsyn for the gate driver 23 and provides them to the source and gate drivers 22 and 23, respectively. A voltage source circuit 25 supplies in advance the source driver 22 with a plurality of predetermined source voltages VS and supplies the gate driver 23 with a predetermined gate voltage VG. Further, the voltage source circuit 25 feeds a common voltage VCo to a plurality of points around the perimeter of the common electrode 5, although only a single feed point 5A is shown in FIG. 1. The source driver 22 selects one of the source voltages VS in accordance with an image data signal $D_S$ fed thereto upon each application of the horizontal synchronizing signal Hsyn and, in response to the vertical synchronizing signal Vsyn, the source driver 22 provides the source voltages, which it has held so far, as pixel voltages to the source lines $X_1$ through $X_n$ at the same time. The gate driver 23 sequentially selects the gate lines $Y_1$ to $Y_m$ in synchronization with the vertical synchronizing signal Vsyn and provides the gate voltages VG to the selected gate lines, respectively. In this way, the TFTs 3 arranged in matrix form are turned ON for each selected gate line, and during the ON period of the TFTs 3 the pixel voltages from the source driver 22 charge pixel capacitances C formed between the respective pixel electrodes 4 and the common electrode 5 through the TFTs 3 held in the ON state. Such a basic configuration is now used in ordinary active matrix LCDs.

Referring next to FIG. 2, a method for driving the active matrix LCD of FIG. 1 will be described. In FIG. 2 Rows A, B and C show gate control signals $V_{YA}, V_{YB}, V_{YC}, \ldots$ are sequentially fed from the gate driver 23 to the gate lines $Y_1, Y_2, Y_3, \ldots$ in synchronization with the vertical synchronizing signal Vsyn. One period Tv of each of the gate control signals $V_{YA}, V_{YB}, V_{YC}, \ldots$ corresponds to one frame period and the H-logic period $T_H$ of the gate control signal $V_Y$ corresponds to one horizontal scanning period.

Upon application of the gate control signal $V_{YA}$ to the gate line $Y_1$, for instance, the TFTs 3 connected to the gate line $Y_1$ are all turned ON. In this state the pixel voltages are simultaneously applied from the source driver 22 to the source lines $X_1, X_2, X_3, \ldots X_n$ to provide via each TFT 3 to the pixel electrode 4 the pixel voltage for determining the luminance of each pixel. In FIG. 2 Row D, Va shows a typical pixel voltage that is fed to one of the TFTs 3 connected to the gate line $Y_1$; similarly Vb and Vc each show a typical pixel voltage that is applied to one of the TFTs 3 connected to the gate lines $Y_3$ and $Y_5$, respectively.

Between the pixel electrode 4 and the common electrode 5 there is formed an electrostatic capacitance (hereinafter referred to as a pixel capacitance) C across the liquid crystal. Accordingly, the pixel voltages fed to the pixel electrodes 4 via the TFTs 3 are charged in the pixel capacitance C. When the gate control signal $V_{YA}$ goes down to the L logic, the TFTS 3 connected to the gate line $Y_1$ are all turned OFF. During the interval between the turning-OFF of the TFTs 3 and the commencement of the next pixel scanning on the same gate line $Y_1$, the electrical charge stored in the pixel capacitance C gradually leaks and hence decreases but it remains essentially at a level high enough to keep the luminance of pixels of the gate line $Y_1$. FIG. 2 Row E shows the pixel voltage that is applied to one pixel and held at such a level. Assuming that the pixel voltage Va (see FIG. 2 Row D) is being applied during the H-logic period of the gate control signal $V_{YA}$, the voltage that is fed to the pixel electrode 4 slightly drops when the gate control signal $V_{YA}$ goes down to the L logic, and thereafter the voltage gradually decreases due to a current that leaks across the liquid crystal until the next scanning begins.

For example, in the case of interlaced scanning of the pixel arrays, the pixel voltage Vb shown in FIG. 2 Row D is fed to any one of the TFTs 3 connected to the gate line $Y_3$. That is, in the horizontal scanning period $t_1, t_2, t_3$, the gate control signals $V_{YA}, V_{YB}, V_{YC}, \ldots$ are applied to the gate lines $Y_1, Y_3, Y_5, Y_7, \ldots$, respectively, by which, for each horizontal scanning period, the pixel voltages are fed to the pixel electrodes 4 on the gate line of the current horizontal scanning to provide an image display. Incidentally, the voltages Va, Vb, Vc, . . . , which are provided to the respective pixels, are inverted in polarity every frame as shown in FIG. 2 Row D to prevent the application of a DC voltage to the liquid crystal over the long term so as to avoid its degradation.

As described above, the active matrix LCD with TFTs holds, in the pixel capacitance C between each pixel electrode 4 and the common electrode 5, the voltage immediately prior to the returning of each TFT 3 to the OFF state until the commencement of the next frame, thereby maintaining the luminance of each pixel. Upon application of the pixel voltage to each pixel electrode 4 on one horizontal scanning line, a charging current flows through the pixel capacitance C between the pixel electrode 4 and the common electrode 5. On the other hand, ITO (Indium Tin Oxide), which is commonly used to form the common electrode 5, is relatively high in resistance as compared with metal electrodes; the passage of the pixel capacitance charging current through the common electrode of a relatively high sheet resistivity causes fluctuations in the common potential, which changes the luminance of each pixel being displayed, leading to the generation of what is called crosstalk. In practice, there exist stray capacitances between the source lines $X_1$ to $X_n$ and the common electrode 5 and between the gate lines $Y_1$ to $Y_m$ and the common electrode, and source-drain and gate-drain capacitances of each TFT 3. It is considered, therefore, that the application of the source drive voltage by the source driver and the application of the gate voltage by the gate driver as well as the pixel capacitance charging current for each selected gate line cause ripples in the common potential of the common electrode 5 and all contribute to the generation of crosstalk.

FIG. 2 Row F shows variations in the potential at the common electrode 5. Whenever all the TFTs 3 connected to each of the gate lines $Y_1$, $Y_2$, $Y_3$, . . . are turned ON by the sequential application thereto of the gate control signals $V_{YA}$, $V_{YB}$, $V_{YC}$, . . . as shown and, at the same time, the pixel voltages are applied to the source lines $X_1$, $X_2$, $X_3$, . . . after being inverted in polarity, the common potential VC goes positive or negative from a reference voltage VCi in correspondence with the polarity of each pixel voltage. A voltage ΔVo that appears at the end of the common potential variation affects the luminance of the pixels on the current horizontal scanning line. The voltage ΔVo, in particular, varies corresponding to the accumulated value of the pixel voltages applied to the respective pixel electrodes during one horizontal scanning period, and hence it is not a single potential and is said to be difficult to cancel. This phenomenon is commonly called crosstalk and its solution is proposed in Japanese Patent Application Laid-Open No. 77950/95, for instance. The solution proposed in this prior art application is to suppress the variation of the common potential by a compensating voltage corresponding to the accumulated value of the pixel voltages fed to the pixel electrodes during one horizontal scanning period.

The conventional compensating method involves, however, the use of a large-scale correcting circuit and hence is costly. Further, since this compensating method is one that generates the compensating voltage corresponding to the accumulated value of the pixel voltages and applies the compensating voltage to the LCD panel, no feedback system is used. Hence, this method has difficulty in adjusting the common potential to the right value without excessive or insufficient compensation.

SUMMARY OF THE INVENTION

It is therefore an object of the present invention to provide a simple-structured, low-cost liquid crystal display device equipped with a common potential stabilizing circuit.

Another object of the present invention is to provide a liquid crystal display device with a stabilized common potential which operates in a proper state even if unadjusted.

According to a first aspect of the present invention, an active matrix LCD with TFTs is provided with common potential stabilizing means which detects the potential at the common electrode, applies a signal representative of the detected potential to an inverting input terminal of a differential amplifier to generate a difference signal between the detected potential and a variable reference voltage, and feeds the difference signal back to the common electrode to suppress potential variations at the common electrode.

According to a second aspect of the present invention, an active matrix LCD with TFTs is provided with common potential stabilizing means which detects a potential variation at the common electrode, inputs a signal representative of the detected potential to a polarity-inverting amplifier and feeds therefrom a phase-inverted signal back to the common electrode to suppress the potential variation at the common electrode.

According to the first and second aspects of the invention, the common potential stabilizing means can be formed by a differential amplifier or inverting amplifier and some other parts, and hence it can be fabricated at low cost.

Further, the common potential stabilizing means is formed by a closed loop (a negative feedback loop) containing the differential amplifier or inverting amplifier, and it can be operated in the proper state once it is assembled. Hence, no particular adjustment is needed—this also permits reduction of the manufacturing cost.

DESCRIPTION OF THE PREFERRED EMBODIMENTS

Figure 1:
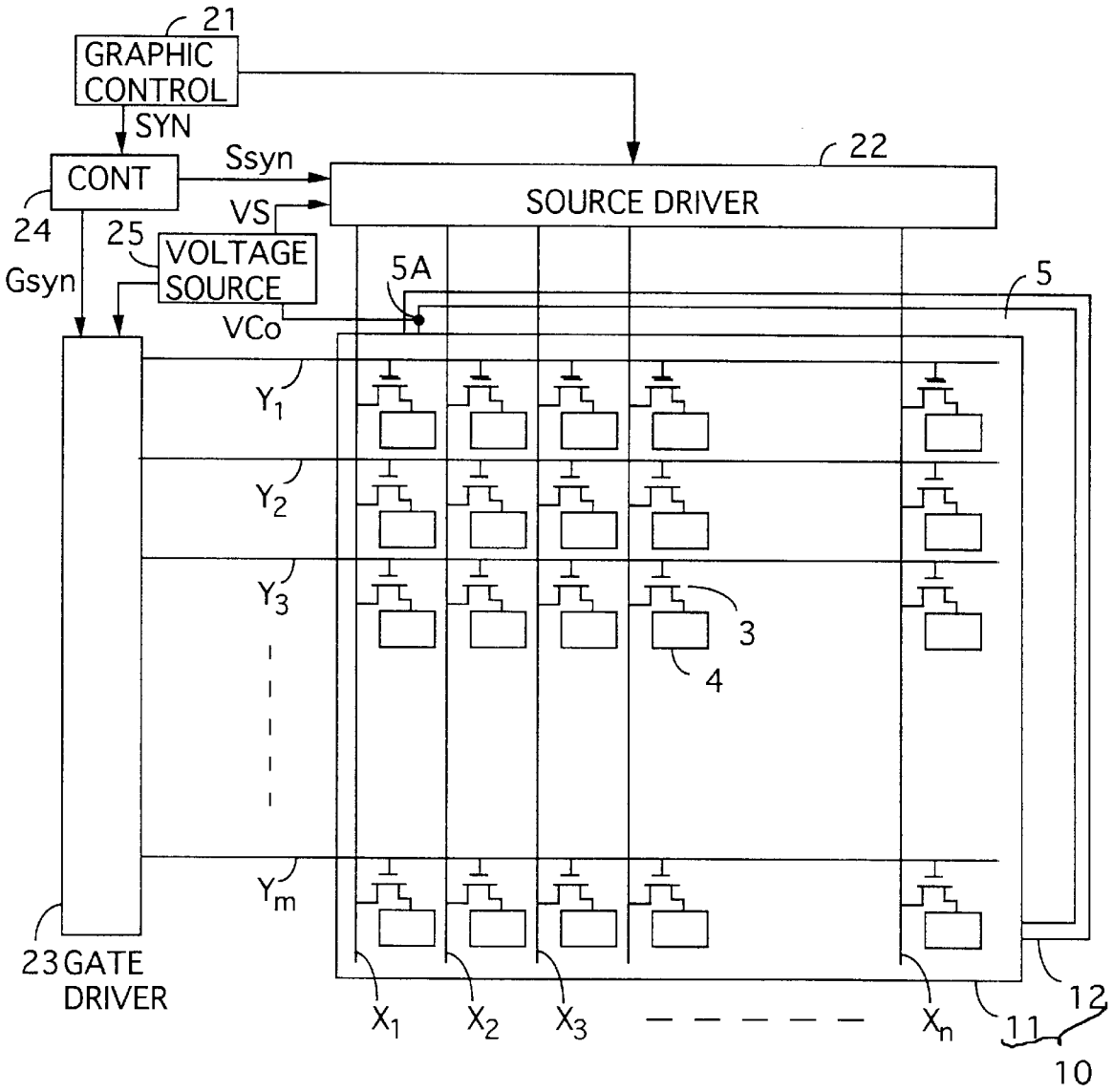
PRIOR ART FIG. 1
FIG. 1 is a connection diagram for explaining a prior art active matrix liquid crystal display.
Figure 3:
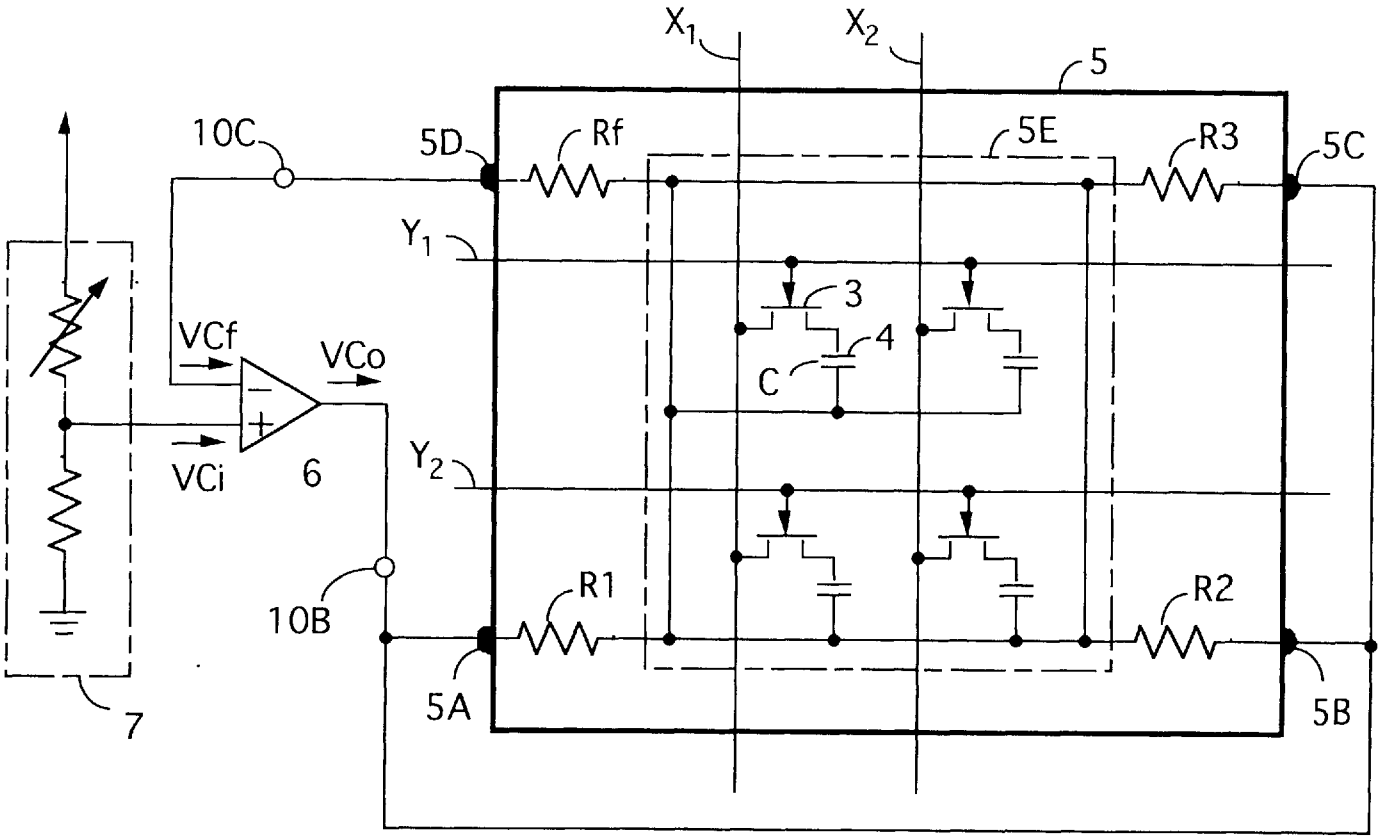
FIG. 3 is a connection diagram for explaining the basic configuration of an embodiment of the present invention.

In FIG. 3 there is illustrated an embodiment of the liquid crystal display device according to the present invention. The liquid crystal panel 10 in this embodiment is identical in construction with the liquid crystal panel 10 shown in FIG. 1, but in FIG. 3 only one part of the TFT matrix array in FIG. 1 is shown in association with equivalent circuits of the pixel electrodes and the common electrode. That is, FIG. 3 illustrates an example of the present invention applied to an electrical equivalent circuit of the active matrix LCD panel with the TFTs 3. For the sake of brevity, the graphic controller 21, the source driver 22, the gate driver 237 the control circuit 24 and the voltage source 25 in FIG. 1 are not shown. The active matrix LCD panel can be expressed by the common electrode 5, the gate lines $Y_1$, $Y_2$, . . . , the source lines $X_1$, $X_2$, . . . , the TFTs 3, the pixel electrodes 4 and the pixel capacitance C formed between each pixel electrode 4 and the common electrode 5.

Reference numerals 5A, 5B, 5C and 5D denote common voltage supply terminals formed around the perimeter of the common electrode 5. While this embodiment is shown to have a plurality of common voltage supply terminals provided around the perimeter of the common electrode 5 to feed thereto the common voltage to provide therein the common potential distribution as uniformly as possible, a single common voltage supply terminal may also suffice. Of these terminals, the terminal 5D is defined as a common voltage detecting terminal, from which the potential VC of the common electrode 5 is detected. It is preferable that the common voltage detecting terminal 5D be placed as far away as possible from the common voltage supply terminals 5A, 5B and 5C. In this embodiment the four terminals 5A to 5D are each positioned near one of four corners of the rectangular common electrode 5.

In the present invention, the potential over the display area 5E of the common electrode 5 corresponding to the display area in which the pixel electrodes are arranged is regarded as an equal potential (i.e. the electrical resistance is regarded negligibly small) and the resistances of the common electrode 5 from the common electrode display area 5E to the terminals 5A to 5D at the perimeter of the common electrode 5 will hereinafter be identified equivalently as R1, R2, R3 and Rf, respectively. In the following description the common potential VC of the common electrode 5 will be defined as indicating the potential in the display area 5E of the common electrode 5 and the common potential that is detected at the terminal 5D through the resistance Rf will be represented by VCf.

In the illustrated embodiment the detection signal VCf, obtained by detecting the potential VC of the common electrode 5, is applied to an inverting input terminal of a differential amplifier 6. A fixed voltage VCi is fed from a reference voltage source 7 to a non-inverting input terminal of the differential amplifier 6, the output terminal of the differential amplifier 6 is connected to the plurality of voltage supply terminals 5A, 5B and 5C, and a differential output voltage VCo between the detection signal VCf and the fixed voltage VCi is provided as a set common potential to the common electrode 5. The differential amplifier 6 forms a negative feedback circuit together with the equivalent resistances R1, R2, R3 and Rf and forms a common potential stabilizing means in combination with the reference voltage source 7. Incidentally, the reference voltage source 7 may be built in the voltage source circuit 25 in FIG. 1.

Figure 4:
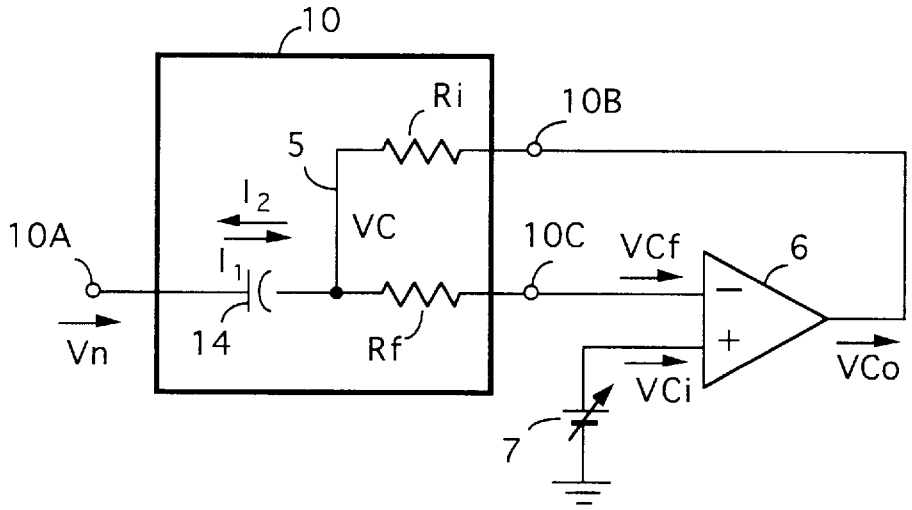
FIG. 4 is an equivalent circuit diagram illustrating the FIG. 3 embodiment in a simplified form.

FIG. 4 is an equivalent circuit diagram illustrating, in more simplified form, the LCD panel having the common potential stabilizing means connected thereto. Reference numeral 10 denotes generally the LCD panel. A resistor Ri is an equivalent resistor that has a value of a parallel connection of the equivalent resistances R1, R2 and R3 of the common electrode 5 in FIG. 3, and a resistor Rf is an equivalent resistance from the common electrode display area 5E to the voltage detecting terminal 5D. These resistors Ri and Rf are interconnected in the display area 5E. Connected to their connection point is one end of a total equivalent stray capacitance 14 inclusive of all pixel capacitances and stray capacitances of all the source and gate lines with respect to the common electrode, which contributes to the common potential variation, and the other end of the equivalent stray capacitance 14 is connected to a terminal 10A. The terminal 10A represents all of the source and gate lines into which disturbance component Vn, which contributes to the common potential variation, is input.

The resistor Ri is connected at the other end to a terminal 10B, to which the output terminal of the differential amplifier 6 is connected. The resistor Rf is connected at the other end to a terminal 10C, from which the detection signal VCf is fed to the inverting input terminal of the differential amplifier 6. To the non-inverting input terminal of the differential amplifier 6 is applied the reference voltage VCi from the reference voltage source 7. The reference voltage source 7 is configured so that the reference voltage VCi can be adjusted to permit the setting of the optimum common voltage in the common electrode 5 from the differential amplifier 6. The differential amplifier 6 amplifies the difference between the input voltages VCf and VCi by its gain and provides the amplified output as a set common voltage VCo, which is negatively fed back to the inverting input terminal of the differential amplifier 6 via the resistors Ri and Rf; hence, the differential amplifier 6 operates so that the input voltage VCf will ultimately become nearly equal to the reference voltage VCi.

With the configuration described above, assuming that, for example, a positive drive voltage is applied to the source or gate of each TFT 3 mainly via the source or gate lines $X_1$, $X_2$, . . . or $Y_1$, $Y_2$, . . . , a disturbance voltage resulting from the drive voltage is fed to the terminal 10A and a charging current $I_1$ (see FIG. 4) flows toward the common electrode 5 via the equivalent stray capacitance 14. Since the charging current $I_1$ raises the set common potential VCo, the potential VC of the common electrode 5 increases and this potential is fed back to the inverting input terminal of the differential amplifier 6 via the resistor Rf.

When the voltage VCf input into the inverting input terminal of the differential amplifier 6 exceeds the reference voltage VCi, the output voltage from the differential amplifier 6 changes in direction to go below the voltage VCi. This voltage drop is provided via the terminal 10B to the common electrode 5 to keep its potential VC from increasing.

Where the drive voltage to be applied to the source or gate lines is a negative-going voltage, a discharge current $I_2$ flows toward the terminal 10A from the common electrode 5 via the equivalent stray capacitance 14. The discharge current $I_2$ causes the potential VC of the common electrode 5 to go negative. This voltage is provided as the potential VCf to the inverting input terminal of the differential amplifier 6, and when it becomes lower than the reference voltage VCi, the output voltage VCo from the differential amplifier 6 becomes higher than the reference voltage Vci, suppressing a decrease in the potential of the common electrode 5.

As described above, even if the potential VC of the common electrode 5 goes positive or negative owing to the supply of the pixel voltage, voltage in a direction in which to cancel the potential variation is output from the differential amplifier 6 to keep the common potential VC of the common electrode 5 constant, so that the potential variation of the common electrode 5 can be suppressed. In practice, the pixel voltages fed to the source lines $X_1$, $X_2$, . . . , for instance, usually differ and the stray capacitances of the source and gate lines differ according to the position on the common electrode 5. Moreover, the common electrode 5 has a uniform sheet resistance even in the display area 5E. Hence, the common potential VC varies differently according to the position in the display area of the common electrode 5, but in the present invention such variation components distributed in such a manner are detected as an average variation from the detecting terminal 10C, which can be suppressed by the negative feedback circuit formed by the differential amplifier 6 and the resistors Ri and Rf shown in FIG. 4. The negative feedback circuit constitutes the common potential stabilizing means as referred to previously.

Figure 2:
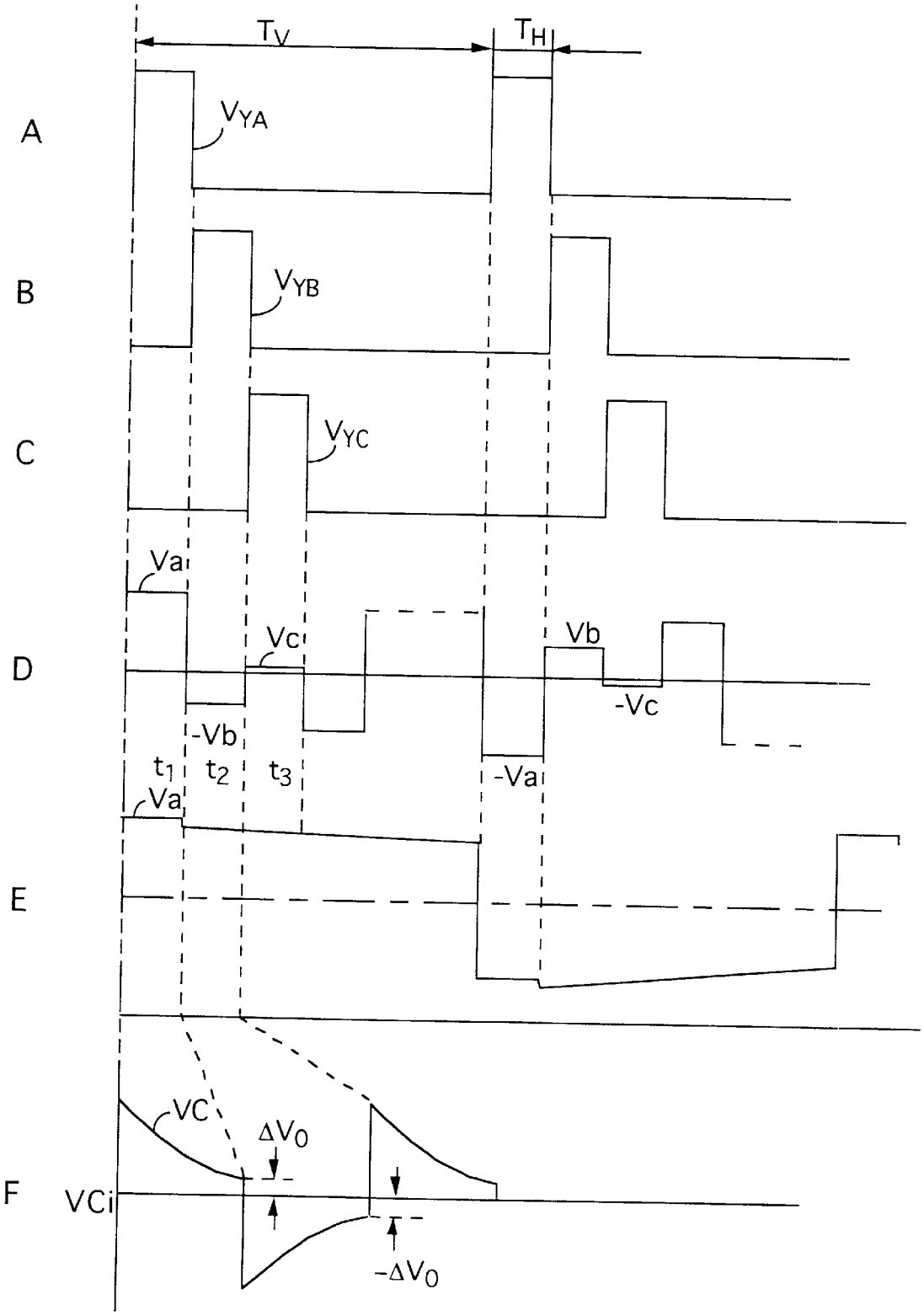
PRIOR ART FIG.2
FIG. 2 is a diagram showing waveforms occurring at respective parts in FIG. 1, for explaining the operation of the prior art display.
Figure 5:
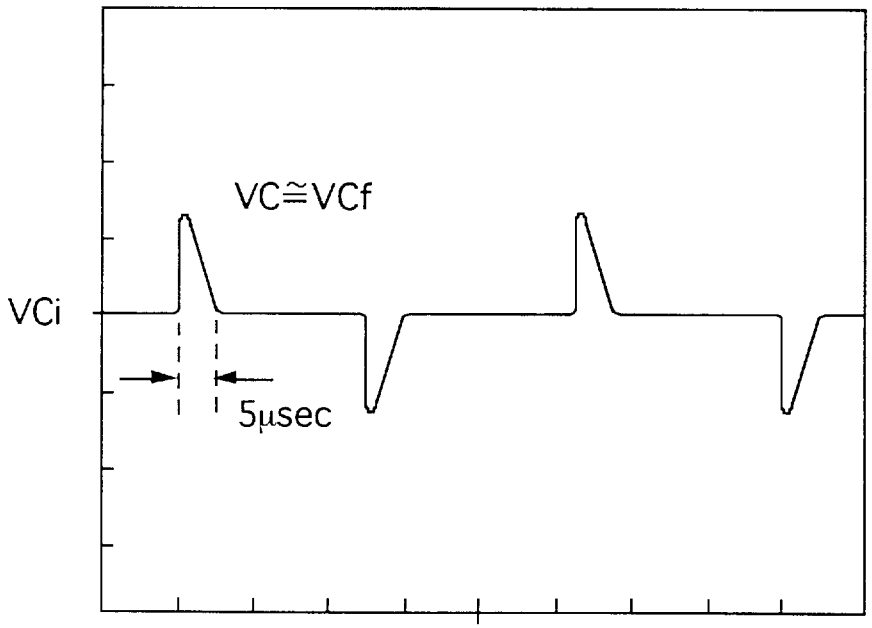
FIG. 5 is a diagram showing a waveform obtained by measuring common voltage variations when the present invention was employed.

In FIG. 5 there is shown waveform data obtained by measuring variations in the potential VC=VCf of the common electrode 5 at the terminal 5D (FIG. 3) in the case of driving the LCD according to the present invention while inverting the polarity of the pixel voltage to be fed to each source line upon each selection of one gate line. As depicted in FIG. 5, according to the present invention, the potential VC of the common electrode 5 changes to the direction corresponding to the polarity of the pixel voltage immediately after the TFTs 3 on one horizontal scanning line are all turned ON, but within a very short time (about 5 μs in the measured example) thereafter the common potential VC is returned to the initial value of the common voltage (the reference voltage) VCi. The reason that a minute ripple of 5 μs developed is that the output current from the differential amplifier 6 was subject to constraints by limitations imposed on parts of the drivers used and on the power source voltage. This ripple could be further suppressed by the application of the present invention based on a design wherein the differential amplifier has a sufficient current capacity and a sufficient current characteristic. In the LCD according to the present invention, since the common potential VC is always equal to the reference voltage VCi, the voltage ΔVo (FIG. 2 Row F) resulting from the potential variation of the common electrode 5 will not remain the pixel capacitance C when each TFT 3 goes back to the OFF state. Thus, the luminance of each pixel is determined only by the input pixel voltage and no crosstalk will occur on the horizontal scanning line.

Figure 6:
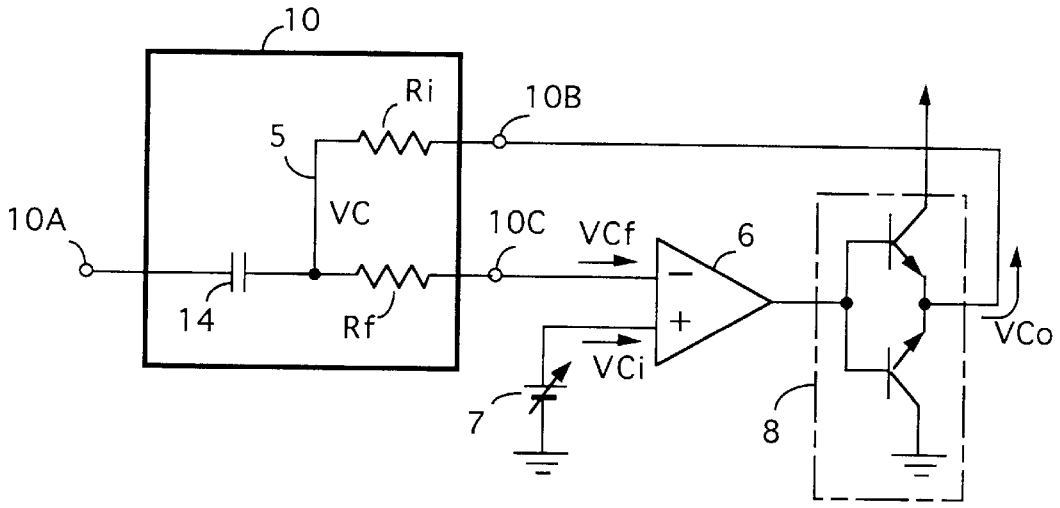
FIG. 6 is a connection diagram for explaining a modified form of the FIG. 3 embodiment.

FIG. 6 illustrates a modified form of the FIG. 3 embodiment, in which a current amplifier 8 is connected between the output of the differential amplifier 6 and the LCD panel 10. This configuration enables the negative feedback loop to follow relatively large variations in the common potential as mentioned above with reference to FIG. 5, and hence it permits suppression of the common potential variation.

Figure 7:
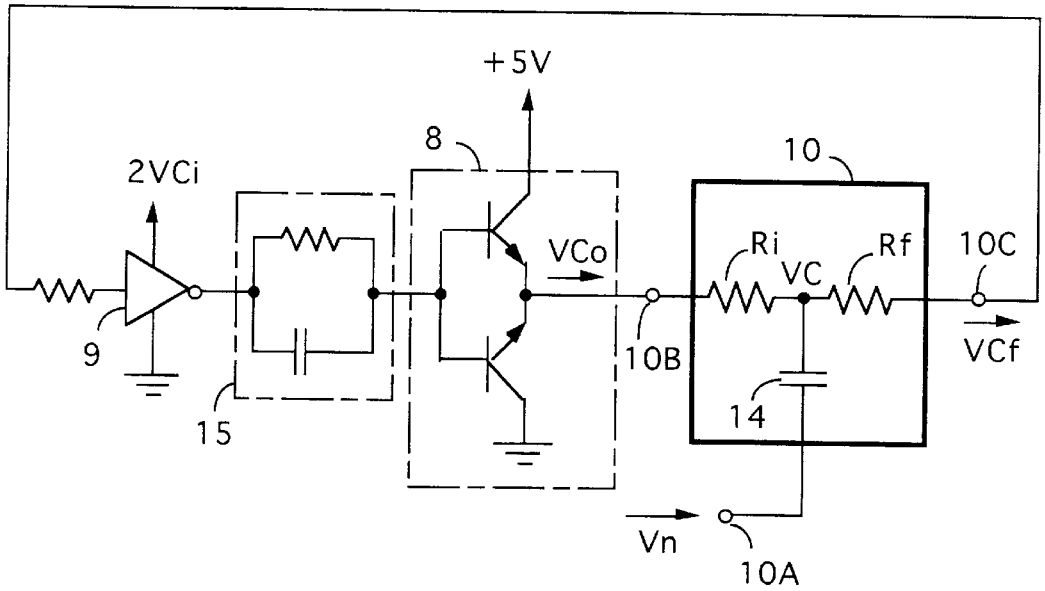
FIG. 7 is a connection diagram for explaining another modified form of the FIG. 3 embodiment.

FIG. 7 illustrates an embodiment of a common potential stabilized LCD according to the second aspect of the present invention. In this embodiment a phase-inverted signal of the disturbance component Vn from the terminal 10A is applied to the voltage supply terminal 10B of the LCD panel 10 to cancel the potential variation of the common electrode 5. This embodiment utilizes, for example, the configuration of an ordinary inverting amplifier that generates its output signal by inverting the polarity of the input signal about a voltage one-half its power supply voltage; that is, this embodiment employs, as a substitute for the differential amplifier 6 in FIG. 4, a inverting amplifier 9 formed by P- and N-channel FETs that are complementary to each other. The reference voltage VCi for the polarity inversion is provided by selecting the power supply voltage of the inverting amplifier 9 to be twice larger than the required reference voltage VCi.

That is, the differential amplifier 6 in FIG. 6 operates on the reference voltage VCi, whereas in FIG. 7 the voltage 2VCi is provided as the power supply voltage to invert the waveform of the detected variation component with reference to the voltage VCi and the inverted component is fed as the set common voltage VCo to the voltage supply terminal 10B. As a result, the variation component of the common potential can be suppressed as is the case with the FIG. 6 embodiment. Hence, the inverting amplifier 9, which is connected between the voltage supply terminal 10B and the voltage detecting terminal 10C and forms part of the feedback loop, constitutes common potential stabilizing means. Incidentally, when the inverting amplifier 9 is formed by FETs of different ON-resistance characteristics, a power supply voltage corresponding to their ON-resistance ratio needs only to be supplied to the amplifier 9.

Thus, according to this embodiment, it is possible to employ a configuration which takes out the potential variation signal VCf of the common electrode 5 from the terminal 10C, amplifies the potential variation signal VCf by the inverting amplifier 9 in the opposite polarity and provides the amplified output as the set common voltage VCo to the terminal 10B via a phase adjustment circuit 15 and the current amplifier 8.

This embodiment is shown to have the current amplifier 8 at the output side of the inverting amplifier 9, but when the amplifier 9 has a sufficiently large current output capacity, the current amplifier 8 need not always be used. The phase adjustment circuit 15 is a speed-up circuit for the current amplifier 8 and is not always necessary. The phase adjustment circuit 15 may be applied to the FIG. 6 example as well.

With the configuration of FIG. 7, since the disturbance component Vn to be fed to the terminal 10A of the LCD panel 10 is applied to the terminal 10B thereof after being amplified by the inverting amplifier 9 in the opposite polarity, the phase of the signal fed to the terminal 10B is 180° out of phase with the signal that is output from the terminal 10C. As a result, when the potential VC of the common electrode 5 is about to, for example, increase owing to the disturbance component Vn fed from the terminal 10A, the voltage increase signal is inverted in polarity and then fed back to the terminal 10A of the LCD panel 10, so that this polarity-inverted signal is applied via the terminal 10B to the common electrode 5. Accordingly, the disturbance component Vn input via the terminal 10A is cancelled by the signal that is fed via the terminal 10B.

Figure 8:
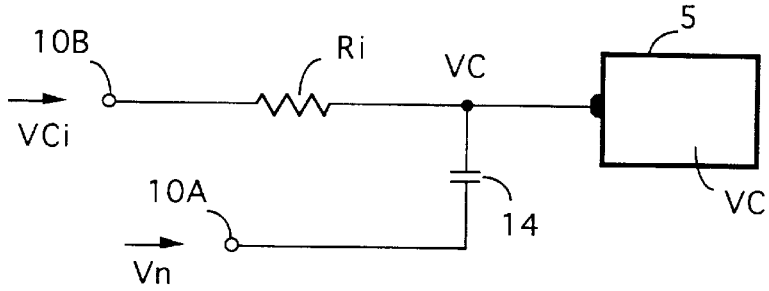
FIG. 8 is an equivalent circuit diagram for explaining the route for intrusion of a disturbance component into the prior art example.
Figure 9:
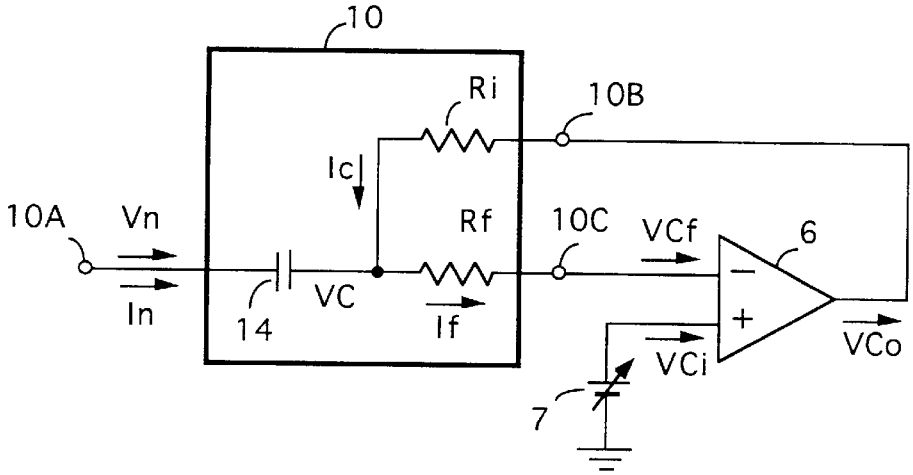
FIG. 9 is an equivalent circuit diagram for explaining the principle of operation and effect of the present invention with the aid of a mathematical expression.

Next, the principle of operation for stabilizing the common potential in the LCD of the present invention will be described using mathematical expressions. FIG. 8 is an equivalent circuit diagram showing the route for intrusion of the disturbance component Vn into the common electrode 5 in the prior art. In the route of intrusion of the disturbance component Vn, the potential VC of the common electrode 5 is given by the following equation:

$$VC=Vci(1/SC)/\{Ri+1/S\cdot C)\}+Vn\cdot Ri/\{Ri+(1/S\sqrt{C})\}=(Vci+Vn\cdot S\cdot C\cdot Ri)/(1+S\cdot C\cdot Ri) \quad (1)$$

where S represents a Laplace transformation. Eq. (1) shows that the common potential VC is affected by the disturbance component Vn.

In contrast to this, letting the voltages at respective parts of the LCD of the present invention be identified by the same reference characters as in the FIG. 4 example and letting the current flowing through the equivalent resistors Ri and Rf be represented by Ic and If, respectively, and the current flowing through the terminal 10A due to the disturbance component Vn be represented, by In, the potential VC of the common electrode 5 can be calculated as described below.

Assuming that the input resistance of the differential amplifier 6 is sufficiently large, $$In+Ic=If=0$$

by Kirchhoff's law.

This can also be written as follows:

$$(Vn - VC)/(1/S \cdot C) + (VCo - VC)/Ri = 0 \quad (2)$$

$$(Vn \cdot S \cdot C \cdot Ri - VC \cdot S \cdot C \cdot Ri) + VCo - VC = 0$$

$$VC \cdot (1 + S \cdot C \cdot Ri) - Vn \cdot S \cdot C \cdot Ri = VCo$$

Letting the gain of the amplifier 6 be represented by Ga, the following equation can be obtained from the input/output relationship.

$$VCi+(VCi-VC)\cdot Ga=VCo\ VCi\cdot(1+Ga)-VC\cdot Ga=VCo \quad (3)$$

Calculated from Eqs. (2) and (3), the potential VC is given by the following equation:

$$VC\cdot(1+S\cdot C\cdot Ri)-Vn\cdot S\cdot C\cdot Ri=VCi\cdot(1+Ga)-VC\cdot Ga \quad (4)$$

$$VC\cdot(1+S\cdot C\cdot Ri+Ga)=VCi\cdot(1+Ga)+Vn\cdot S\cdot C\cdot Ri$$

$$VC=\{VCi\cdot(1+Ga)+Vn\cdot S\cdot C\cdot Ri\}/(1+S\cdot C\cdot Ri+Ga)$$

Now, assuming that the gain Ga of the differential amplifier 6 is sufficiently larger than unity, 1+Ga=Ga, Eq. (4) becomes as follows:

$$VC=(VCi\cdot Ga+Vn\cdot S\cdot C\cdot Ri)/(Ga+S\cdot C\cdot Ri)=(VCi+Vn\cdot S\cdot C\cdot Ri/Ga)/(1+S\cdot C\cdot Ri/Ga) \quad (5)$$

Comparison of Eqs. (5) and (1) reveals that the part C·Ri in Eq. (1) representing the disturbance component Vn of the common potential VC is changed to C·Ri/Ga in Eq. (5).

Hence, according to the present invention, the equivalent resistance Ri of the lead wire, for instance, can be compressed by the amplifier 6 to a reciprocal multiple of its gain Ga (in the case of using an ordinary operational amplifier, its gain Ga usually takes a value exceeding tens of thousands). Further, it can be seen that also in the case of considering the equivalent resistance Ri as a time constant, the capability of responding to the disturbance can be extremely improved. The reference voltage VCi has been described to be a DC voltage, but even if it is a rectangular wave as in a common voltage inverting drive scheme, the difference is only that the reference voltage VCi is processed as a step response VCi/S, and a similar mathematical expansion is possible. In other words, the present invention can be applied independently of the waveform of the reference voltage VCi.

While the embodiment of FIGS. 3 and 4 according to the first aspect of the present invention has been described to apply the DC voltage as the common voltage VC to drive the LCD, the common voltage inverting drive scheme may sometimes be used as an ordinary LCD drive method with the view to reducing the required amplitude of the source signal as disclosed in, for example, Japanese Patent Application Laid-Open No. 4213/91. In such an instance, the common electrode 5 is supplied with a rectangular common voltage whose potential is inverted with a predetermined voltage width about a reference bias voltage every horizontal scanning period. The present invention described previously in respect of FIGS. 3 and 4 may be applied to such a common voltage inverting drive scheme.

Figure 10:
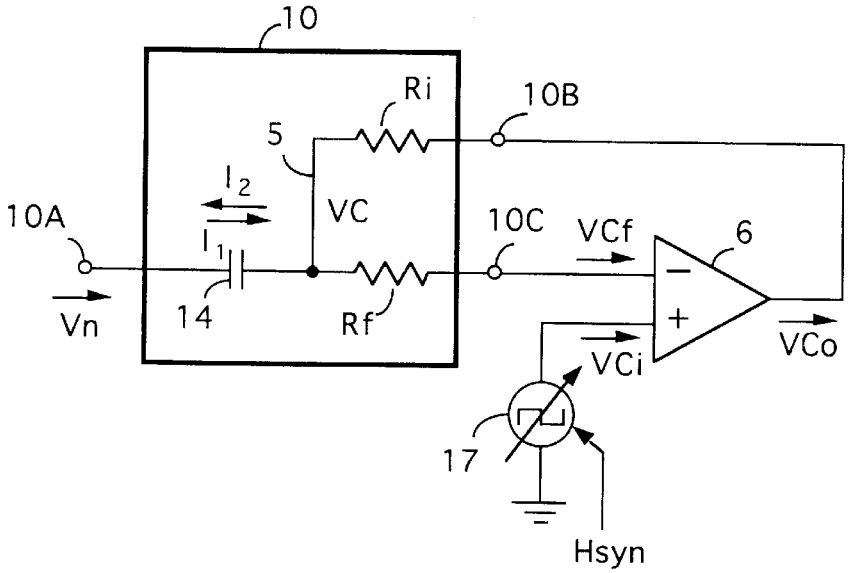
FIG. 10 is an equivalent circuit diagram for explaining another embodiment of the present invention.

In such a case, a rectangular voltage source 17 is used as the reference voltage source as shown in FIG. 10 which corresponds to FIG. 4. For example, in the case where the example of the drive method shown in FIG. 2 Row D is a line-by-line alternate drive scheme, a rectangular voltage, which is inverted with a predetermined voltage width about the reference bias voltage VCi upon each application of the horizontal scanning synchronizing signal Hsyn, is applied from the control signal 34 in FIG. 1 to the non-inverting input terminal of the differential amplifier 6 in synchronization with the horizontal scanning synchronizing signal Hsyn. Consequently, the negative feedback loop, inclusive of the differential amplifier 6, suppresses variation components of the common voltage VC in high- and low-level periods of the rectangular voltage, respectively, so that the voltage VC becomes equal to the high and low levels of those periods that are used as reference voltages. In the example of FIG. 10, the reference bias voltage for the rectangular voltage, that is, its average voltage, and the voltage width about which potential inverts, are adjustable independently of one another. Such a rectangular voltage source 17 can be built in the voltage source 25 shown in FIG. 1, for instance.

As described above, according to the present invention, the control loop for stabilizing the potential of the common electrode 5 of the LCD device can be implemented in a simple configuration by using either the differential amplifier 6 or inverting amplifier 9, and hence it is low-cost. Moreover, since automatic control is effected by the closed loop, the LCD device can be operated in the proper state once it is assembled. Therefore, it is possible to offer a crosstalk-free liquid crystal display that does not involve any adjustment and hence is labor-saving. Besides, the present invention has the advantage of providing a crosstalk-free liquid crystal display with a large display screen.

It will be apparent that many modifications and variations may be effected without departing from the scope of the novel concepts of the present invention.

What is claimed is:

1. A matrix active liquid crystal display device which has TFTs arranged in matrix form as switching elements, comprising:

a common substrate having a common electrode coated almost all over an inner surface of said common substrate and having a voltage detecting terminal and a plurality of voltage supply terminals disposed apart from one another around the perimeter of said common electrode, said plurality of voltage supply terminals being connected with one another;

an array substrate disposed opposite said common electrode with liquid crystal sealed therebetween, said array substrate having formed thereon said TFTs arranged in matrix form, pixel electrodes each connected to one of said TFTs, source lines each connected to one of columns of said matrix of TFTs and gate lines each connected to one of rows of said matrix of TFTs;

a reference voltage source for generating a variable DC reference voltage; and a differential amplifier which has an inverting input terminal connected to said voltage detecting terminal and a non-inverting input terminal connected to said reference voltage source, said differential amplifier being operative to amplify the difference between said variable DC reference voltage and the detected voltage from said voltage detecting terminal and to provide the amplified output as a set common voltage to said voltage supply terminals, thereby forming common potential stabilizing means for a feedback loop.

2. A matrix active liquid crystal display device which has TFTs arranged in matrix form as switching elements, comprising:

a common substrate having a common electrode coated almost all over an inner surface of said common substrate and having a voltage detecting terminal and a plurality of voltage supply terminals disposed apart from one another around the perimeter of said common electrode, said plurality of voltage supply terminals being connected with one another;

an array substrate disposed opposite said common electrode with liquid crystal sealed therebetween, said array substrate having formed thereon said TFTs arranged in matrix form, pixel electrodes each connected to one of said TFTs, source lines each connected to one of columns of said matrix of TFTs and gate lines each connected to one of rows of said matrix of TFTs;

a reference voltage source for generating a reference voltage that is a predetermined multiple higher than a predetermined reference common voltage; and an inverting amplifier which is supplied with said reference voltage as a power supply voltage, inverts a voltage variation relative to said reference common voltage that is detected at said voltage detecting terminal and provides the inverted output as a set common voltage to said voltage supply terminals, thereby forming common potential stabilizing means.

3. The display device of claim 1 or 2, wherein said common electrode is substantially square in shape, said voltage supply terminals being positioned near three corners of said common electrode and said voltage detecting terminal being positioned near the remaining corner.

4. The display device of claim 1 or 2, further comprising a current amplifier connected between the output of said common potential stabilizing means and said voltage supply terminals, said set common voltage being provided via said current amplifier to said voltage supply terminals.

5. The display device of claim 2, wherein the DC power supply voltage of said inverting amplifier is so set as to obtain an optimum common potential.

6. A matrix active liquid crystal display device which has TFTs arranged in matrix form as switching elements, comprising:

a common substrate having a common electrode coated almost all over an inner surface of said common substrate and having a voltage detecting terminal and a plurality of voltage supply terminals disposed apart from one another around the perimeter of said common electrode, said plurality of voltage supply terminals being connected with one another;

an array substrate disposed opposite said common electrode with liquid crystal sealed therebetween, said array substrate having formed thereon said TFTs arranged in matrix form, pixel electrodes each connected to one of said TFTs, source lines each connected to one of columns of said matrix of TFTs and gate lines each connected to one of rows of said matrix of TFTs;

a reference voltage source for generating a reference voltage in the form of a rectangular wave; and a differential amplifier which has an inverting input terminal connected to said voltage detecting terminal and a non-inverting input terminal connected to said reference voltage source, said differential amplifier being operative to amplify the difference between said rectangular wave reference voltage and the detected voltage from said voltage detecting terminal and to provide the amplified output as a set common voltage to said plurality of voltage supply terminals, thereby providing common potential stabilizing means.

7. The display device of claim 6, wherein said reference voltage source is capable of changing the amplitude and mean voltage value of said rectangular wave independently of each other.

* * * * *